US005259570A

United States Patent [19]

Sochard

[11] Patent Number: 5,259,570

[45] Date of Patent: Nov. 9, 1993

[54] LASER RESISTANT OPTICAL DETECTOR ARRANGEMENT

[75] Inventor: Irving I. Sochard, Chevy Chase, Md.

[73] Assignee: The United States of America as represented by the Secretary of the Navy, Washington, D.C.

[21] Appl. No.: 497,367

[22] Filed: Aug. 12, 1974

[51] Int. Cl.[5] ..... F41G 7/26

[52] U.S. Cl. ..... 244/3.16

[58] Field of Search ..... 244/3.16, 3.17, 3.18; 102/70.2 P, 211, 213; 250/347

[56] References Cited

U.S. PATENT DOCUMENTS 3,268,185 8/1966 Eckermann ..... 244/3.18

3,621,784 11/1972 Mundie et al. ..... 102/70.2 P 3,774,213 11/1973 Riggs ..... 102/70.2 P

*Primary Examiner*—Stephen C. Bentley

*Attorney, Agent, or Firm*—John D. Lewis

[57] ABSTRACT

A device for protecting a missile guidance system from laser attack by supplying replacement detectors if the working detector is damaged. The replacement detector can either be mounted on an indexing turret such that each detector can be alternately rotated into the focal position or they can be mounted in fixed positions and a mirror rotated to each fixed position.

6 Claims, 1 Drawing Sheet

LASER RESISTANT OPTICAL DETECTOR ARRANGEMENT

BACKGROUND OF THE INVENTION

High power lasers have been developed for use in point defense systems against missile attack. Most of the missiles deployed in such attacks are equipped with optical systems which are essential for successful warhead delivery. The detectors in such systems are more vulnerable than most other parts of these missiles. This results from a combination of two factors; first, selecting a material to be a good detector puts such a severe constraint on what is suitable that one cannot then incorporate much resistance to laser attack as well; second, the optical signature of most military targets is weak enough that an optical gain system using mirrors or lenses must be used on the missiles to concentrate the radiation from the target into the detector. Such optical systems typically have a concentration factor (gain) of 1,000 to 1,000,000 times. If such a system is exposed to a powerful laser the same energy concentration factor applies which is most times more than enough energy to quickly destroy the detector. Common methods used in the prior art to prevent detector damage have consisted of restricting either: the wavelength of radiation sensed by the detector; the angle of view of the detector; or the viewing time of the detector. The problem with each of these methods of protecting detectors is that they severely restrict the operation of the guidance system of the projectile. In addition, they are limited in their ability to protect the detector since each of the defenses can be defeated if the laser incorporates the proper wavelength, proper angle, or, is emitted at the proper time, in accordance with the particular defense being used. Further, restricting the viewing time of the detector has been found to be an ineffective defense since those which are effective only when hit by a laser beam are too slow for pulsed lasers and those which work on a random basis either do not provide enough protection or severely limit the accuracy of the projectile.

SUMMARY OF THE INVENTION

The present invention overcomes the disadvantages and limitations of the prior art by providing a laser attack protection device using multiple detectors. The system protects the guidance system of a projectile from destruction by lasers by providing additional detectors to replace a damaged working detector. The replacement detector can either be mounted on an indexing turret such that each detector can be alternately rotated into the proper focal position or they can be mounted in fixed positions and a mirror rotated to each fixed position.

It is therefore an object of the present invention to provide an improved device for protection of a projectile from laser attack.

It is also an object of the present invention is to provide a device for effectively protecting a projectile from laser attack.

Another object of the invention to provide a device for reliably protecting a projectile from laser attack without severely affecting the guidance system of the projectile.

Other objects, advantages and novel features of the invention will become apparent from the following detailed description of the invention when considered in conjunction with the accompanying drawings wherein:

DETAILED DESCRIPTION OF THE PREFERRED EMBODIMENT

Figure 1:
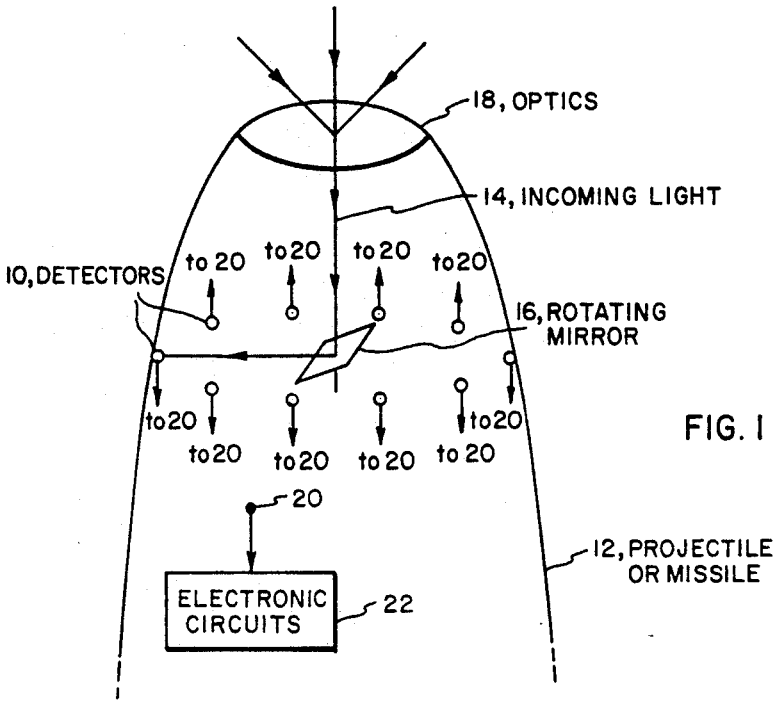
FIG. 1 shows a device for protecting the guidance system of a projectile using a rotating mirror.
Figure 2:
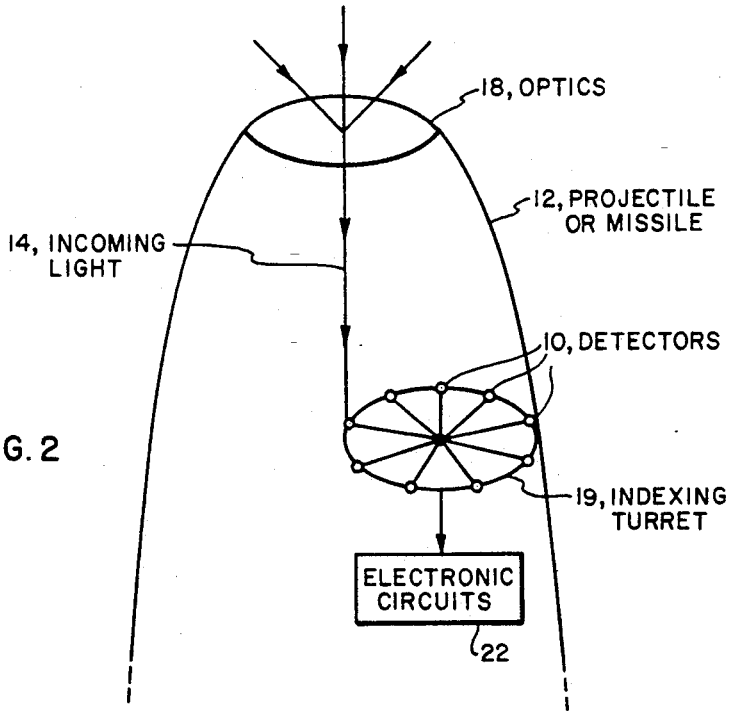
FIG. 2 shows a device for protecting the guidance system of a projectile using an indexing turret.

The present invention consists of an array of several replacement detectors for each working detector in a projectile which is mounted so that if the working detector is destroyed or damaged a replacement detector can be switched into operation. FIGS. 1 and 2 show two ways the replacement detector can be put into the optical system.

FIG. 1 discloses a device for projecting the incoming radiation 14 to one of a series of detectors 10 which are fixed in the projectile 12 and which are successively addressed by a mirror 16 capable of rotating to any of a series of indexed positions to bring each detector into the optical path of the incoming radiation 14. The information scanned by the projectile is converged to a beam 14 of incoming light by optics 18. Upon destruction of a detector by, for example, a laser, the rotating mirror is indexed to align the incoming radiation with another detector. Since all of the detectors are connected to a common input 20 to the electronic circuits 22, it does not matter which of the detectors 10 is being addressed. A major feature of this device is that it would be able to handle multiple targets. Laser beams which have contemplated for use against optical scanning fuzes can be rapidly retargeted from missile to missile so as to destroy the detectors of numerous missiles in a short period. The invention disclosed here would make this impossible. After initially destroying a detector in the present device it would still have to stay directed on the same target for a period of time to prevent the replacement detector from reactivating the projectile's tracking ability.

In fact, a short time delay from the switching from one detector to the next could be introduced to allow a destructive laser beam to shift to its next target.

FIG. 2 discloses a device for successively rotating a series of detectors 10 mounted on an indexing turret 18 into the optical path of an incoming beam 14. Each of the detectors is rotated into position in the same manner the rotating mirror 16 is rotated to an index position. Similarly, each of the detectors is connected to the electronic circuits 22.

A major advantage of the present invention is that it would severely limit the multitarget ability of even highly sophisticated destructive laser systems. The present invention can, of course, also be used in conjunction with the other types of detector defenses used in the prior art an even better system. However the present invention is more foolproof than the prior art since a short enough pulsed laser at the right place, time and wavelength can circumvent any of these other prior art approaches.

Obviously many modifications and variations of the present invention are possible in light of the above teachings.

For example, each detector 10 in either FIGS. 1 or 2 might be permanently connected it its own single chip preamp to increase output and decrease noise. Also, if the system is cryogenic, all the detectors can be connected to a common heat sink which would not significantly change the cooling requirements over that of a single detector.

It is therefore to be understood that within the scope of the appended claims the invention may be practiced otherwise than as specifically described.

What is claimed as new and secured by Letters Patent of the United States is:

1. A device for protection of an optically responsive projectile from destruction by a laser beam comprising:

at least one working detector located in the optical path of radiation impingent on said projectile;

at least one replacement detector located outside the optical path of said radiation;

means for switching at least one replacement detector into said optical path of said radiation to replace said working detector upon destruction by said laser beam.

2. The device of claim 1 wherein said means for switching comprises reflective means for deflecting said optical path to at least one replacement detector fixed in said projectile.

3. The device of claim 2 wherein said means for switching comprises an indexing turret with at least one replacement detector fixed thereto.

4. The device of claim 1 wherein said projectile comprises a missile.

5. The device of claim 2 wherein said projectile comprises a missile.

6. The device of claim 3 wherein said projectile comprises a missile.

* * * * *